United States Patent [19]

Grubb et al.

[11] 4,282,679

[45] Aug. 11, 1981

[54] INFANT'S TOY—RATTLE AND PEEK-A-BOO BALL

[75] Inventors: Lawrence B. Grubb, Monkton; Danny E. Simpson, Baltimore, both of Md.; Louis S. Hoffman, Morristown, N.J.; David M. Williams, Montreal, Canada

[73] Assignee: Johnson & Johnson Baby Products Company, New Brunswick, N.J.

[21] Appl. No.: 96,074

[22] Filed: Nov. 20, 1979

[51] Int. Cl.[3] ..... A63H 5/00

[52] U.S. Cl. ..... 46/193; 46/175 R

[58] Field of Search ..... 46/193, 1 R, 190, 189, 46/191, 11, 175 R; D21/65, 64; 273/156, 160

[56] References Cited

U.S. PATENT DOCUMENTS

| | | | |
|---|---|---|---|
| D. 141,522 | 6/1945 | Davidson | 46/193 UX |
| D. 183,883 | 11/1958 | Gordon | D21/65 |
| 3,235,263 | 2/1966 | Smith | 46/11 |
| 3,464,151 | 9/1969 | Motley | 46/193 |
| 3,633,587 | 1/1972 | Hunt | 46/175 |
| 3,710,504 | 1/1973 | Rylands | 46/193 |
| 3,813,099 | 5/1974 | Scott | 273/156 |
| 4,008,526 | 2/1977 | Swett et al. | 46/17 |
| 4,081,972 | 4/1978 | Kotlav | 46/193 |
| 4,170,106 | 10/1979 | Koslosky | 46/193 |

*Primary Examiner*—Gene Mancene
*Assistant Examiner*—Michael J. Foycik, Jr.
*Attorney, Agent, or Firm*—Jason Lipow

[57] ABSTRACT

An infant's toy with a hollow ball having openings disposed about its surface and having a freely movable insert trapped within the hollow ball, said insert provided with a pair of pivotally connected stems with a cage structure disposed at the end of each stem, each cage structure containing at least one loosely confined ball. The cage structures are readily movable in and out of the openings of the hollow ball but the insert is restrained from being removed from the hollow ball.

7 Claims, 3 Drawing Figures

INFANT'S TOY—RATTLE AND PEEK-A-BOO BALL

FIELD OF THE INVENTION

The instant invention relates to an infant's toy which is a combination of both a rattle and a ball and is adaptable to various configurations for infants' play.

BACKGROUND OF THE PRIOR ART

Various combinations of rattles and balls are known in the art, In U.S. Pat. No. 3,633,587 there is shown an infant's toy which is a ball-like structure in cage form which contains another ball or noise-producing member confined within the structure. In U.S. Pat. No. 4,081,972 there is disclosed a cage-like member of varying configurations which has loosely confined within that cage-like member smaller members of varying configurations.

Also, there are other patents on various types of toy rattles, as for example, U.S. Pat. No. 2,226,806 and U.S. Pat. No. 2,247,873 as well as patents on various ball-shaped configurations which are hollow and may be grasped such as disclosed in U.S. Pat. No. 4,008,526.

Of course, many sizes and types of toys have been made in the vast field of entertainment especially for small children, and it is a field that is never completely filled and one in which we are always looking for something new. Children tend to tire quickly of a toy, or in many instances, the toy may be easily broken or the toy may be too advanced for the child. Our new toy provides lengthy enjoyment for the child, is not easily broken, and is especially suitable for the youngest infant. The improved toy of the present invention provides in a single structure means of satisfying the principal interests of an infant or young child. These include sound, visual excitement, both color and motion, and manipulative experience through reaching, grasping, pulling and tucking.

SUMMARY OF THE PRESENT INVENTION

The present invention is an infant's toy comprising a hollow ball. The ball has at least three openings disposed about its surface with a distance between at least two of these openings being such that it may be readily grasped by an older infant. Each of the openings is of a size that an infant may insert its hand therethrough, into the hollow ball. A freely movable insert is trapped inside the hollow ball. The insert comprises a pair of pivotally connected stems with a cage structure disposed at the end of each stem. Confined within each cage structure is at least one loose ball. The cage structures are of a size such as to be readily movable in and out of the openings of the ball. A retaining disc larger than the openings in the ball is disposed inside the ball. The disc has a hole in the center and the pair of pivotally extending stems are disposed through this hole. The hole is large enough to readily accept the stems but small enough so that the cage structure cannot be pulled through the hole. When the ball is played with, a cage structure will readily become accessible through any one of the openings while the other cage structure is confined within the ball. This allows the infant not only to grasp the ball itself but grasp one of the cage structures and to shake, shape, and manipulate the entire toy.

In a preferred embodiment, the hollow ball and the insert are constructed of rigid materials such that they make a rattling sound when they strike each other.

In a still preferred embodiment of the infant toy of the present invention, there are sufficient openings in the hollow ball such that the space between any adjacent openings may be readily grasped by the hand of an infant. We have found that from four to seven openings are especially suitable for use in the hollow ball member of the toy of the present invention.

DETAILED DESCRIPTION OF THE DRAWINGS

Figure 1:
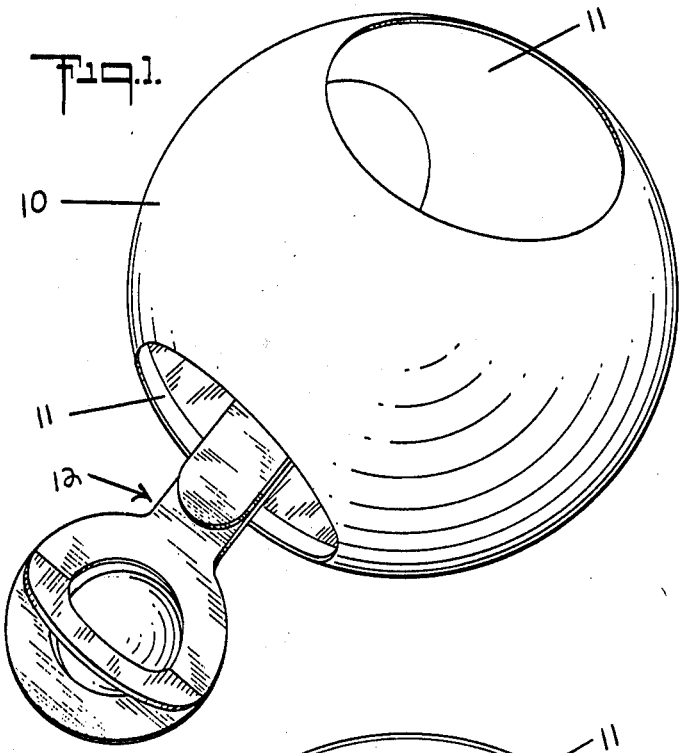
FIG. 1 is a front perspective view of one embodiment of the toy of the present invention.

The preferred embodiment of the infant's toy of the present invention, shown in FIG. 1, comprises a hollow ball 10 having at least three openings 11 disposed about its surface. Each opening is large enough for an infant's hand to pass through into the ball 10. The ball 10 may be easily grasped about the edges of the openings 11. In addition, the distance between at least two of the openings 11 is such that it may be spanned and the ball grasped by the hand of an older infant.

Figure 3:
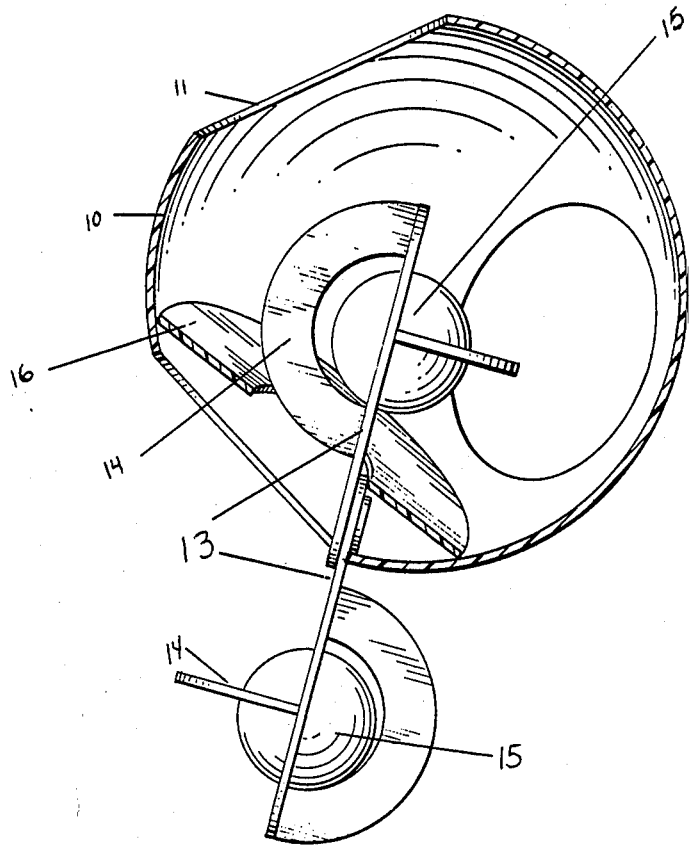
FIG. 3 is a right side view in partial cross-section of the toy shown in FIG. 1.

A freely movable insert 12 is trapped inside the hollow ball 10. As shown in FIG. 3, the insert comprises a pair of pivotally connected stems 13 with a cage structure 14 disposed at the end of each stem. When the stems are disposed along a straight line, the length of the insert is greater than the diameter of the hollow ball 10, but the insert may nestle within the hollow ball due to the pivotal connection of the two stems. Enclosed within each cage structure is a loosely confined ball 15. The confined ball 15 may be readily turned and manipulated within the cage. The cage structure 14 is of a size such as to be readily movable in and out of the openings of the ball.

A retaining means 16 prevents the insert from falling out of or being withdrawn from the hollow ball 10. In the preferred embodiment of the toy of this invention, the retaining means comprises a disc whose diameter is greater than the diameter of the openings 11 in the hollow ball 10. The retaining means has a hole in the center through which the pair of pivotally extending stems are disposed. The hole is large enough for the stems to move freely therethrough but is smaller than the cage structures, which cannot be pulled through the hole.

Figure 2:
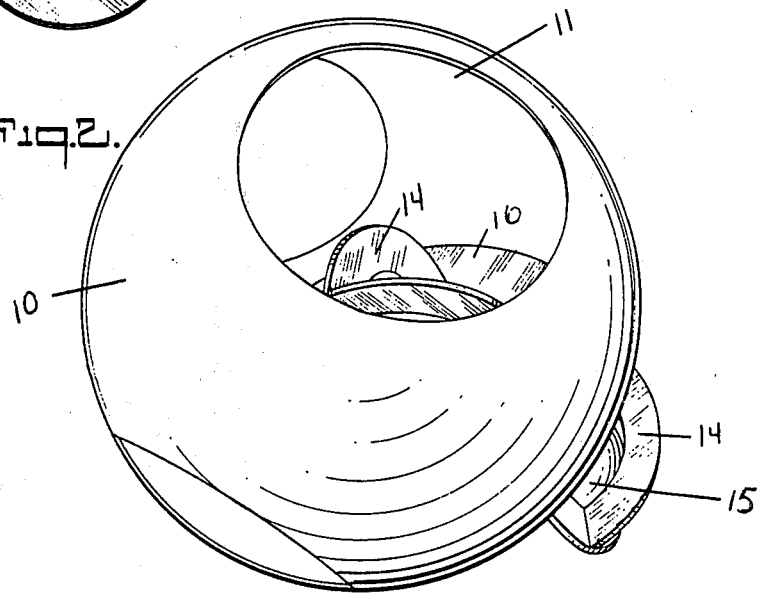
FIG. 2 is a rear perspective view of the toy shown in FIG. 1.

When the cage structure is disposed through an opening 11 in the hollow ball 10, the cage structure may be pulled on and may be used as a handle to shake and rattle the toy. During play, the cage structure of the insert may move freely out of an opening 11 as shown in FIG. 1, thereby making the cage structure and the ball therein available for grasping and handling. However, as shown in FIG. 2, the remaining portion of the insert lies within the hollow ball 10 and is easily seen and accessible through the openings 11.

In a preferred embodiment of the toy of the present invention, both the hollow ball 10 and the insert 12 are made of rigid materials so that the insert 12 rattles against the inner surface of the hollow ball 10. Also, in the preferred embodiment, the hollow ball 10, the cage structures 14 are the confined balls 15 are of different colors.

The foregoing description of the drawings are illustrative and are not to be taken as limiting. Still other variations and modifications are possible without departing from the spirit and scope of the present invention.

What is claimed is:

1. An infant's toy comprising, in combination:

a hollow ball;

an insert for said ball; and retaining means for trapping said insert at least partially within said ball;

said hollow ball having a plurality of openings, the opening being of such a size that the hand of an infant may be readily inserted therethrough into the hollow ball;

said insert having an elongated stem portion with first and second enlarged portions at each end thereof, said enlarged portions being small enough to fit through said hollow ball openings;

said retaining means being provided within said hollow ball and having a maximum dimension sufficient to prevent said retaining means from being withdrawn from said ball through said hollow ball openings while being freely movable inside said ball;

said retaining means being provided with a hole large enough to accommodate the stem of said insert but small enough to prevent said enlarged portion of said insert from passing therethrough;

said insert being provided with one enlarged portion inside said hollow ball and with said stem passing through the hole of said retaining means and with said second enlarged portion extending out of a hollow ball opening;

whereby the configuration of the toy may be freely varied by having any of said insert enlarged portions pass through any of said hollow ball openings while said insert is still restrained by said retaining means.

2. The toy of claim 1 wherein said plurality of openings comprise at least three openings.

3. The toy of claim 1 wherein said elongated stem portion of said insert comprises a pair of pivotally connected stems.

4. The toy of claim 1 wherein said enlarged portions of said insert comprises cage structures.

5. The toy of claim 4 wherein said cage structures contain a loosely confined ball.

6. The toy of claim 1 wherein said retaining means comprises a disk.

7. An infant's toy comprising in combnation:

a hollow ball;

an insert for said ball; and retaining means for trapping said insert at least partially within said ball;

said hollow ball having at least three openings disposed about its surface, the openings being of such a size that the hand of an infant may be readily inserted therethrough into the hollow ball;

said insert having an enlarged stem portion comprising a pair of pivotally connected stems and first and second enlarged portions comprising a cage structure at each end thereof;

said cage structure including a loosely confined ball and said enlarged portions being small enough to fit through one of said hollow ball openings;

said retaining means being provided within said hollow ball and having a maximum dimension sufficient to prevent said retaining means from being withdrawn from said ball through said hollow ball openings while being freely movable inside said ball;

said retaining means being provided with a hole large enough to accommodate the stem of said insert but small enough to prevent said enlarged portion of said insert from passing therethrough;

said insert being provided with one enlarged portion inside said hollow ball and with said stem passing through the hole of said retaining means and with said second enlarged portion extending out of a hollow ball opening;

whereby the configuration of the toy may be freely varied by having any of said insert enlargements pass through any of said hollow ball openings while said insert is still restrained by said retaining means.

* * * * *